United States Patent [19]

Bowden

[11] Patent Number: 4,809,369

[45] Date of Patent: Mar. 7, 1989

[54] PORTABLE BODY SHOWER

[76] Inventor: John H. Bowden, 102 Oak Retreat, Cardinal Dr., Brunswick, Ga. 31520

[21] Appl. No.: 87,799

[22] Filed: Aug. 21, 1987

[51] Int. Cl.[4] ..... A47K 3/22

[52] U.S. Cl. ..... 4/615; 4/596; 4/601

[58] Field of Search ..... 4/615, 558, 596, 597, 4/601, 602, 603, 605, 599

[56] References Cited

U.S. PATENT DOCUMENTS

| | | | |
|---|---|---|---|
| 598,987 | 2/1898 | Hammann | 4/558 |
| 615,486 | 12/1898 | Jendis | 4/615 X |
| 2,060,100 | 11/1936 | Michelson | 4/615 X |
| 3,724,760 | 4/1973 | Smith | 4/596 X |
| 4,282,612 | 8/1981 | Kind | 4/615 X |
| 4,545,083 | 10/1985 | Searson | 4/615 |
| 4,648,143 | 3/1987 | Breaux et al. | 4/615 X |

FOREIGN PATENT DOCUMENTS

| | | | |
|---|---|---|---|
| 324886 | 4/1903 | France | 4/615 |

*Primary Examiner*—Henry K. Artis

*Attorney, Agent, or Firm*—Burns, Doane, Swecker & Mathis

[57] ABSTRACT

A portable body shower includes a plurality of tubular sections which can be connected to form a pipe with a closed bottom end and a hollow center. The top end of the pipe can be connected to any standard shower extension. The pipe extends downward and has perforations for supplying water in a horizontal direction toward a person showering. The device also includes non-perforated tubular sections so that water is directed at selected areas of a person's body adjacent the perforated sections. A tubular section is also provided for dispensing soap. The body shower includes a swivel joint to enable the pipe to be rotated to direct water in any direction. The tubular sections are made of a plastic material such as polyvinylchloride.

19 Claims, 2 Drawing Sheets

FIG. 1
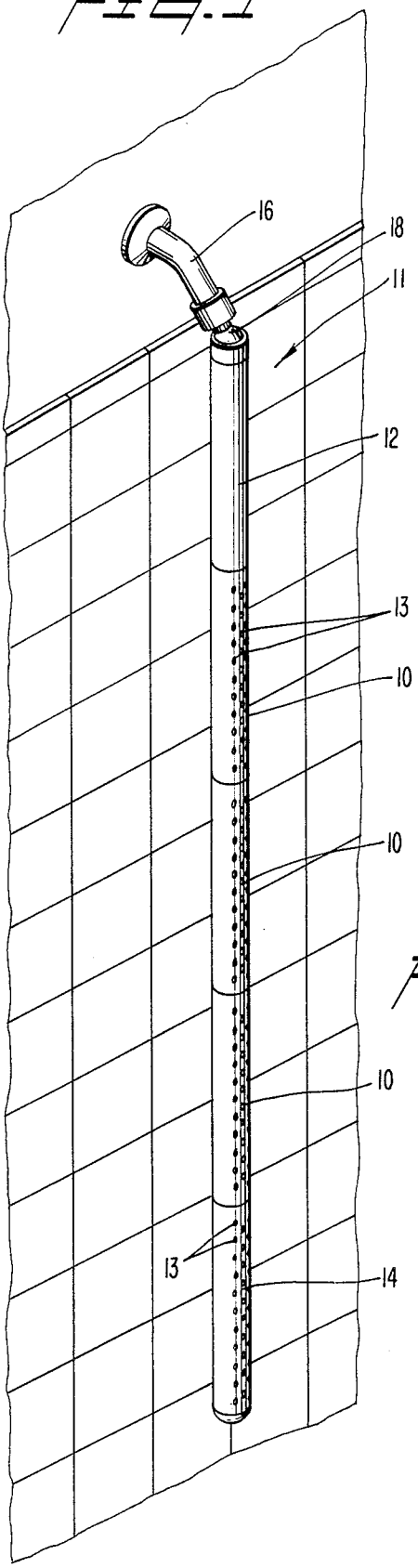
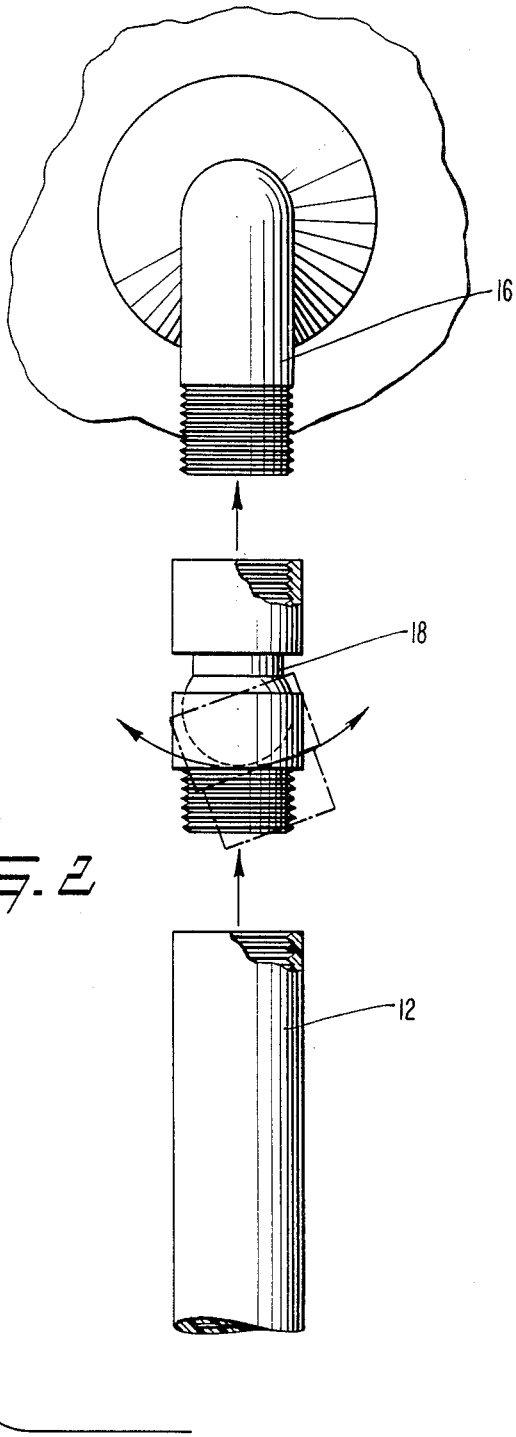
FIG. 2

Fig. 4
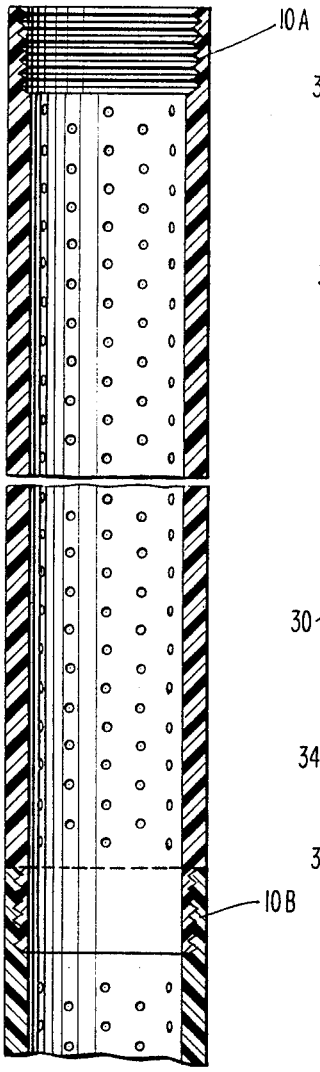
Fig. 5
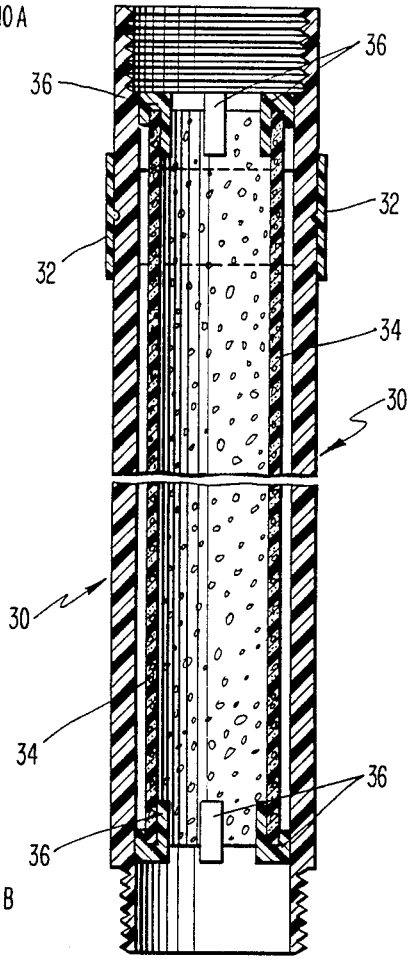
Fig. 6
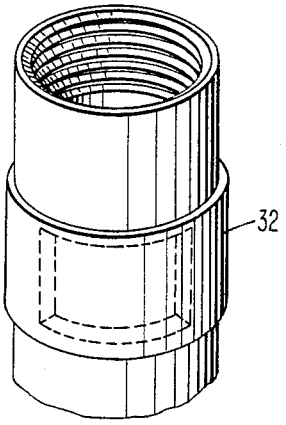
Fig. 7
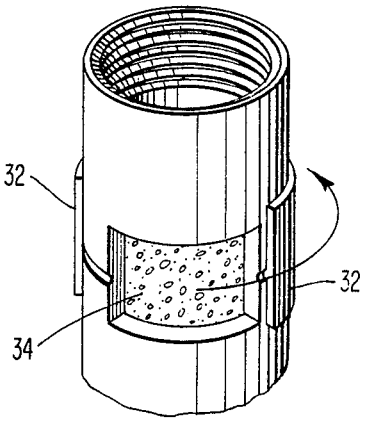
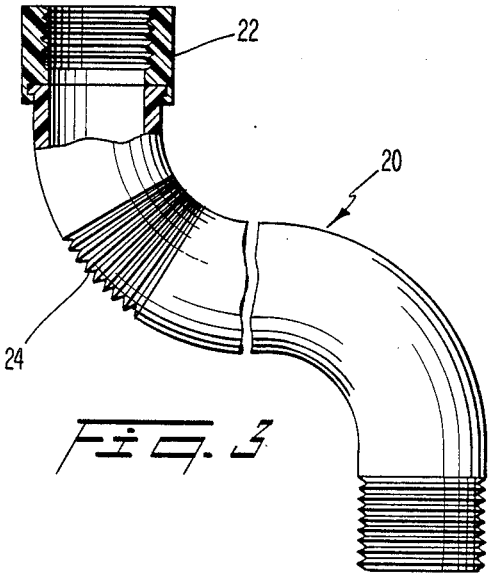
Fig. 3
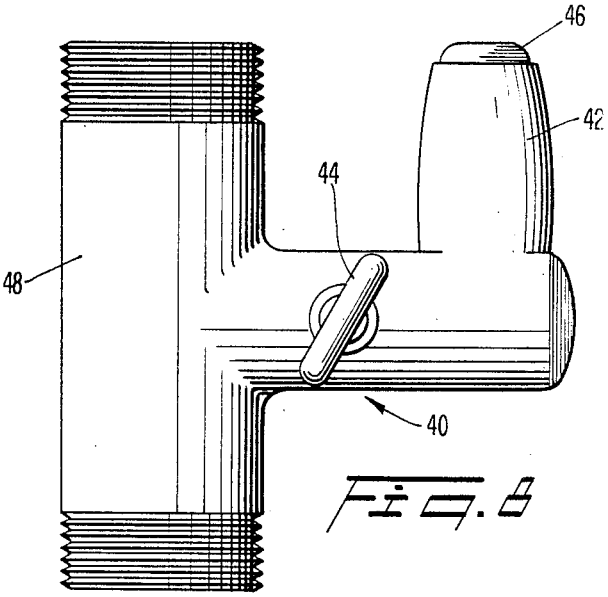
Fig. 8

PORTABLE BODY SHOWER

BACKGROUND OF THE INVENTION

1. Field of the Invention

This invention relates generally to a shower attachment which can be adapted to existing shower pipes and more particularly to a shower attachment which is portable and can be easily assembled, to direct water, under pressure, at selected areas of a person's body.

2. Background Description

It has been heretofore conventional to retrofit a bath with attachments for creating a shower effect and retrofitting an existing shower for altering the spray and increasing the pressure of the water.

Examples of the aforesaid apparatuses are shown by U.S. Pat. Nos. 2,060,100 and 4,545,083. These apparatuses are bulky, consist of numerous parts, and take a considerable length of time to install.

U.S. Pat. No. 615,486 discloses a device which could be connected to a bath to provide a shower effect. The device is vertically mounted and rigidly fixed to a bathroom wall. The device includes sleeves which can close off shower holes along the length of the vertically mounted tube. However, this device is rigidly affixed to a wall, has several parts, and takes time to install.

None of the patents discussed provide for a shower apparatus which can be easily assembled and disassembled, and which is easily transportable and adaptable to any standard shower pipe.

Oftentimes when one travels on business or for pleasure he or she is confronted with using showers which are inadequate in some respect, e.g., low water pressure. It is desirable to have a showering device which is portable and can be adapted to fit any standard showering pipe to provide a showering effect which is the same as that which one is used to, regardless of the type of shower encountered. Also for someone who is injured or has a chronic back problem it may be impossible to use a standard shower, i.e., they can't get water on a wound or they need hot water under pressure applied to a certain area of their body, e.g., the lower back. Without a portable attachment to fit a standard shower pipe these people would find it difficult to shower when away from their home.

A device with a flexible hose attachment is known for directing water at selected areas of a person's body. However, this device requires the user to hold it and manually direct the water where desired. Due to the nature of a person's injury it may be difficult and uncomfortable to reach certain areas of the body. For example, someone with a lower back problem would find it difficult and uncomfortable to rotate their torso to apply the water where desired. This is especially so where hot water under pressure is being used for its therapeutic effect. The therapy may require a long time for the application to be effective. It would be very difficult to hold the device for the required period of time.

The foregoing illustrates limitations known to exist in present devices. Thus, it is apparent that it would be advantageous to provide an alternative directed to overcoming one or more of the limitations set forth above.

Therefore, it is a general object of the present invention to provide a portable showering device which can be adapted to any standard shower pipe.

It is another general object of the present invention to provide a portable showering device which is simple in construction and can be easily assembled and disassembled.

It is another object of the present invention to provide a portable showering device which has therapeutic uses in addition to cleansing uses.

It is another object of the present invention to provide a portable showering device which is non-corrosive and does not require any plumbing.

It is another object of the present invention to provide a portable showering device which does not require any support structure for mounting, other than the shower pipe with which it is connected.

It is yet another object of the present invention to provide a portable showering device which can direct water to specific areas of the body while other areas remain dry.

A further object of the present invention is to provide a portable showering device which is adjustable to a person's height.

It is yet another object of the invention to provide a portable showering device which is rotatable and capable of being used by more than one person at any time to conserve water.

Accordingly, a suitable alternative is provided by the present invention, the features of which are more fully disclosed hereinafter.

SUMMARY OF THE INVENTION

In one aspect of the present invention, the foregoing objects are accomplished by providing a portable body shower including a plurality of tubular sections wherein each section has threaded ends for mating with adjoining sections. A top tubular section has a threaded connector for mating with any standard shower pipe extension. The tubular sections have a plurality of holes arranged along the length of the tubular sections for supplying water in a generally horizontal direction toward a person who is showering. An end tubular section is also provided with its bottom end being closed so that the only outlet for the water is through the plurality of holes. The tubular sections are connected to form a shower pipe which extends downward from the shower pipe extension. The device includes a sufficient number of tubular sections to provide shower water along the body of any person using the portable body shower.

The foregoing and other aspects will become apparent from the following detailed description of the invention when considered in conjunction with the accompanying drawings. It is to be expressly understood, however, that the drawings are not intended as a definition of the invention but are for the purpose of illustration only.

BRIEF DESCRIPTION OF THE DRAWINGS

In the drawing:

FIG. 1 is a pictorial view of one embodiment of the present invention;

FIG. 2 is a pictorial view of a swivel joint attachment of the present invention;

FIG. 3 is a pictorial view of a curved tube top for the portable body shower;

FIG. 4 is a cutaway view showing the connection of the tubular sections;

FIGS. 5–7 illustrate a tubular section for dispensing soap and body conditioners; and FIG. 8 illustrates an alternate embodiment of a tubular section for dispensing soap and body conditioners

DESCRIPTION OF THE PREFERRED EMBODIMENT

A bathtub and shower arrangement is depicted in FIG. 1. A normal shower head has been removed from a standard shower pipe 16. A portable body shower is indicated generally as 11. The portable body shower includes several tubular sections 10 each of a suitable length to facilitate their portability, e.g., approximately nine inches. The individual sections 10 are provided with a series of holes 13 along a forward area. Each section 10 is also threaded at its top 10*a* and bottom 10*b* as shown in FIG. 4, thus permitting individual sections to be attached to each other to form a column of any desired length. A bottom tubular section 14 is provided with a closed rounded bottom end. Also, a top tubular section 12 of a suitable length to facilitate portability, e.g., approximately five inches, is provided with no holes. The top section 12 is attached to a swivel joint 18 at its top end, and is designed to fit a standard (externally threaded) shower pipe 16, as best shown in FIG. 2. The individual sections are preferably made of a durable, temperature-resistant plastic material, such as polyvinylchloride, which can be easily produced through injection molding. The plastic sections are non-corrosive and require no plumbing to repair or install.

In operation, the body shower can be installed by assembling the individual tubular sections 10 according to the length desired.

The body shower can be provided with solid tubular sections in place of the perforated sections. With this arrangement a person can decide to only direct water at selected areas of the body. This is very useful when someone with an injury is required to keep a particular area dry. This arrangement also allows for increasing the water pressure when the number of perforated pipe sections is decreased. For example, a therapeutic effect could be achieved by directing hot water under pressure at the lower back area, by using all solid sections except for the section adjacent the lower back area.

The swivel joint 18 allows the connector to be screwed into the shower pipe without rotating the connected tubular sections. Also, more than one person can use the portable shower attachment at the same time. This feature is provided by the fact that the swivel joint allows the connected tubular sections to be rotated at the joint and thereby allow water to be directed in any radial direction around the vertical shower attachment.

FIG. 3 illustrates a curved tube top for the body shower indicated generally as 20. The curved top is fitted between the portable body shower and a shower pipe to prevent contact of the body shower with a wall or sink. This curved tube top 20 is provided with a loose twist top 22. Also a flexible joint 24 allows the curved tube top 20 to bend to a desired position. The curved tube top 20 can be approximately seven inches long.

FIGS. 5–7 illustrate a body shower soap dispenser 30 which can be inserted in the body shower as one of the tubular sections. A sliding cylindrical section 32 can be opened, as shown in FIG. 7, exposing a sponge 34. Any soap or body conditioner can be applied to the sponge 34 for distribution through the body shower. The sponge 34 is held in position by plastic guards 36. The body shower soap dispenser 30 does not have any outside holes 13 for directing water towards a person showering as the other tubular sections 10 do. Therefore, the soap or conditioner will slowly work its way through the sponge 34 into the inner cavity where it will be carried by the shower water to be applied to the body of a person showering.

FIG. 8 illustrates an alternative embodiment of a body shower soap dispenser indicated generally as 40. This soap dispenser has a tubular section 48 which can be inserted in the body shower as one of the tubular sections. The soap dispenser 40 includes a soap reservoir 42 with a filler cap 46. Soap or body conditioners contained in the reservoir 42 can be released into the shower water by turning an ON/OFF key switch 44. The key switch 44 is connected to a valve on the interior of the soap dispenser 40. The tubular section 48 has a sponge disposed adjacent its hollow interior for absorbing the soap or body conditioner released by the valve and distributing the soap or conditioner more evenly to the shower water passing through the body shower.

The body shower is simple to install and could be positioned by most anyone, including a child, in a few minutes. No significant modification to the standard shower would be required, except the possible placement of a modified (threaded) shower head. When normal shower activities might be desired, such as washing or rinsing one's hair, the body shower could be easily removed, simply by rotating the top section.

While ideally suited for home use, the body shower could be installed wherever showers are installed. This could include various types of locker room installations, such as hospitals and nursing homes.

While the invention has been illustrated and described in accordance with a preferred embodiment, it is recognized that variations and changes may be made and equivalents employed herein without departing from the invention as set forth in the claims.

I claim:

1. A portable body shower, comprising:

a plurality of tubular sections wherein each section has ends for mating with adjoining sections, whereby the height of said body shower may be adjusted depending upon the number of sections joined end to end;

a top tubular section having a connector means for mating with any standard shower pipe extension, said plurality of sections having a plurality of holes arranged along the length of the tubular sections so that water is supplied in a generally horizontal direction toward a person showering;

an end tubular section with its bottom end being closed so that the only outlet for the water is through the plurality of holes; said tubular sections being connected to form a shower pipe which extends downward from the shower pipe extension and includes a sufficient number of tubular sections to provide shower water along the length of a person using the portable body shower.

2. The portable body shower as recited in claim 1, further including non-perforated tubular sections selectively located along the length of said shower pipe whereby water will be directed in a generally horizontal direction only at selected areas of a person's body adjacent the perforated tubular sections.

3. The portable body shower as claimed in claim 2, wherein the individual sections of pipe are constructed of a plastics material.

4. The portable body shower as claimed in claim 3, wherein the plastics material is polyvinylchloride.

5. The portable body shower as claimed in claim 3, further including a non-perforated tubular section located along the length of said body shower and including means for dispensing soap and body conditioners into the shower water.

6. The portable body shower as claimed in claim 3, wherein said connector means includes a swivel joint to enable the shower pipe to be rotated to direct water in any of a plurality of desired directions.

7. The portable body shower as claimed in claim 1 including a curved tube top connected between the portable body shower and a shower pipe wherein said tube top has a flexible joint so that the portable body shower can be positioned away from a wall or sink.

8. A portable body shower, comprising:

a plurality of elongated sections having a hollow interior for supplying shower water, said elongated sections having connector means for mating with each other end to end and whereby the height of said body shower may be adjusted depending upon the number of sections joined together;

a plurality of water outlet means in said elongated sections for supplying water under pressure at a person showering;

a top elongated end section including means for connection to a shower pipe; and a bottom end section having its bottom end closed, said sections being connected end to end and forming a continuous path for water so that the water flow is blocked at the bottom end and must exit said plurality of water outlet means.

9. The portable body shower as recited in claim 8, further including non-perforated tubular sections selectively located along the length of said shower pipe, whereby water will be directed in a generally horizontal direction only at those selected areas of a person's body adjacent the perforated tubular sections with outlet means.

10. A portable body shower as recited in claim 9, wherein the individual elongated sections are constructed of a plastics material.

11. A portable body shower as recited in claim 10, wherein the plastics material is polyvinylchloride.

12. The portable body shower as claimed in claim 10, further including a non-perforate tubular section located along the length of the body shower and including means for dispensing soap and body conditioners into the shower water.

13. A portable body shower as claimed in claim 10, wherein said connector means includes a swivel joint to enable the shower pipe to be rotated to direct water in an of a plurality of directions.

14. The portable body shower as claimed in claim 8 including a curved tube top connected between the portable body shower and a shower pipe wherein said tube top has a flexible joint so that the portable body shower can be positioned away from a wall or sink.

15. The portable body shower of claim 1 wherein the ends of the tubular sections are threaded to mate with adjoining sections.

16. The portable body shower of claim 2 wherein each of said perforated and non-perforated tubular sections is approximately nine inches in length to accommodate their portability.

17. The portable body shower of claim 5 wherein said dispensing means comprises a sponge disposed within said non-perforated tubular section.

18. The portable body shower of claim 8 wherein each of said perforated and non-perforated tubular sections is approximately nine inches in length to accommodate their portability.

19. The portable body shower of claim 12 wherein said dispensing means comprises a sponge disposed within said non-perforated tubular section.

* * * * *